US010702081B2

(12) United States Patent
Allen et al.

(10) Patent No.: US 10,702,081 B2
(45) Date of Patent: Jul. 7, 2020

(54) FRAME FOR A PLANAR DISPLAY PANE

(71) Applicant: LIBERTY HARDWARE MFG. CORP., Winston-Salem, NC (US)

(72) Inventors: Dax Allen, Asheboro, NC (US); James Allen Austin, III, High Point, NC (US)

(73) Assignee: LIBERTY HARDWARE MFG. CORP., Winston-Salem, NC (US)

( * ) Notice: Subject to any disclaimer, the term of this patent is extended or adjusted under 35 U.S.C. 154(b) by 0 days.

(21) Appl. No.: 16/575,752

(22) Filed: Sep. 19, 2019

(65) Prior Publication Data

US 2020/0100605 A1 Apr. 2, 2020

Related U.S. Application Data

(63) Continuation of application No. 16/143,625, filed on Sep. 27, 2018, now Pat. No. 10,455,956.

(51) Int. Cl.
*A47G 1/06* (2006.01)
*A47G 1/02* (2006.01)

(52) U.S. Cl.
CPC ..... *A47G 1/065* (2013.01); *A47G 1/02* (2013.01)

(58) Field of Classification Search
CPC ..... A47G 1/065; A47G 2001/0666; A47G 2001/0677
See application file for complete search history.

(56) References Cited

U.S. PATENT DOCUMENTS 359,316 A * 3/1887 Damlos ..... A14G 1/14 407/734
1,436,615 A * 11/1922 Urbanek ..... G09F 15/0012 40/507
1,895,938 A * 1/1933 Mutschler ..... G09F 1/12 40/611.02
1,946,705 A * 2/1934 Manoil ..... A47G 1/14 40/734
3,039,217 A * 6/1962 Stefanakis ..... A47G 1/00 40/725
3,946,512 A * 3/1976 Shapiro ..... A47G 1/1606 40/759
4,630,386 A * 12/1986 Wilson ..... A47G 1/0605 40/734
5,230,172 A * 7/1993 Hsu ..... A47G 1/06 248/497

(Continued)

*Primary Examiner* — Gary C Hoge
(74) *Attorney, Agent, or Firm* — Brooks Kushman P.C.; Lora Graentzdoerffer

(57) ABSTRACT

A planar display pane assembly includes a frame assembly with a frame with first and second spaced apart and opposed second decorative with first and second openings to receive a planar display pane. A through opening is formed through the frame to view the planar display pane in either direction of the frame. The first opening is formed around the through opening. The second opening is formed around the through opening and facing away from the first opening. A first plurality of fasteners is formed about the first opening. A second plurality of fasteners is formed about the second opening. A plurality of retainers is sized to engage the first plurality of fasteners or the second plurality of fasteners to retain the planar display pane to the frame. The planar display pane is received within the first opening or the second opening.

20 Claims, 4 Drawing Sheets

(56) References Cited

U.S. PATENT DOCUMENTS

| | | | | |
|---|---|---|---|---|
| 5,546,689 | A * | 8/1996 | Bomze | A47G 1/08 40/739 |
| 5,974,714 | A * | 11/1999 | Jones | A47G 1/0605 40/768 |
| 6,775,939 | B1 * | 8/2004 | Juern | A47G 1/065 248/489 |
| 6,782,649 | B1 * | 8/2004 | Adler | A47G 1/065 211/169 |
| 7,146,759 | B2 | 12/2006 | Bell | |
| 9,833,086 | B2 | 12/2017 | Forrest et al. | |
| 2007/0137081 | A1 * | 6/2007 | Chang | A47G 1/0605 40/781 |
| 2010/0139140 | A1 * | 6/2010 | Morgan | A47G 1/0605 40/779 |
| 2012/0222341 | A1 * | 9/2012 | Tucker | A47G 1/06 40/790 |
| 2018/0000264 | A1 * | 1/2018 | Kerl | A47G 1/0633 |
| 2018/0125268 | A1 | 5/2018 | Forrest et al. | |

* cited by examiner

FRAME FOR A PLANAR DISPLAY PANE

CROSS-REFERENCE TO RELATED APPLICATIONS

This application is a continuation of U.S. application Ser. No. 16/143,625 filed Sep. 27, 2018, now U.S. Pat. No. 10,455,956 B1, the disclosure of which is hereby incorporated in its entirety by reference herein.

TECHNICAL FIELD

Various embodiments relate to planar display assemblies, such as mirror assemblies.

BACKGROUND

Prior art planar display assemblies, such as mirror assemblies are disclosed in Forrest et al. U.S. Patent Application Publication No. US 2017/0105551 A1, which published on Apr. 20, 2017, and issued as U.S. Pat. No. 9,833,086 B2, on Dec. 5, 2017.

SUMMARY

According to at least one embodiment, a frame is sized to receive a planar display pane in one of a first opening and a second opening that is spaced apart and opposed to the first opening. A first decorative surface is oriented about the first opening. A second decorative surface that is different from the first decorative surface, is oriented about the second opening.

According to a further embodiment, the first decorative surface has a different surface finish than the second decorative surface.

According to another further embodiment, the first decorative surface has a different shape than the second decorative surface.

According to another further embodiment, a through opening is formed through the frame to view the planar display pane in either direction of the frame.

According to an even further embodiment, the first opening is formed around the through opening. The second opening is formed around the through opening and facing away from the first opening.

According to at least another embodiment, a frame assembly is provided with a frame sized to receive a planar display pane in one of a first opening and a second opening that is spaced apart and opposed to the first opening. A first decorative surface is oriented about the first opening. A second decorative surface that is different from the first decorative surface, is oriented about the second opening. A through opening is formed through the frame to view the planar display pane in either direction of the frame. The first opening is formed around the through opening. The second opening is formed around the through opening and facing away from the first opening. A first plurality of fasteners is formed about the first opening. A second plurality of fasteners is formed about the second opening. A plurality of retainers is sized to engage the first plurality of fasteners or the second plurality of fasteners to retain the planar display pane to the frame.

According to a further embodiment, a trim member is sized to be received in the first opening to cover the first plurality of fasteners when the planar display pane is received in the second opening.

According to an even further embodiment, the trim member is sized to be received in the second opening to cover the second plurality of fasteners when the planar display pane is received in the first opening.

According to another further embodiment, the first plurality of fasteners includes a first plurality of apertures formed into the frame. The second plurality of fasteners includes a second plurality of apertures formed into the frame.

According to an even further embodiment, the plurality of retainers each include a pin sized to be received in one of the first plurality of apertures or one of the second plurality of apertures. A retainer body extends from the pin to engage the planar display pane.

According to another even further embodiment, the first opening is formed to a first blind depth in the frame to provide a first abutment surface to receive and engage the planar display pane. The first plurality of apertures is formed into the frame intersecting the first opening.

According to another even further embodiment, each of the first plurality of apertures is formed generally perpendicular to a first inner sidewall formed in the frame by the first opening.

According to another even further embodiment, the second opening is formed to a second blind depth in the frame to provide a second abutment surface to receive and engage the planar display pane. The second plurality of apertures is formed into the frame intersecting the second opening.

According to another even further embodiment, each of the second plurality of apertures is formed generally perpendicular to a second inner sidewall formed in the frame by the second opening.

According to at least another embodiment, a planar display pane assembly includes a frame assembly provided with a frame that is sized to receive a planar display pane in one of a first opening and a second opening that is spaced apart and opposed to the first opening. A first decorative surface is oriented about the first opening. A second decorative surface that is different from the first decorative surface, is oriented about the second opening. A through opening is formed through the frame to view the planar display pane in either direction of the frame. The first opening is formed around the through opening. The second opening is formed around the through opening and facing away from the first opening. A first plurality of fasteners is formed about the first opening. A second plurality of fasteners is formed about the second opening. A plurality of retainers is sized to engage the first plurality of fasteners or the second plurality of fasteners to retain the planar display pane to the frame. The planar display pane is received within the first opening or the second opening.

According to a further embodiment, the planar display pane includes a mirror.

According to at least another embodiment, a frame is provided with a first decorative surface and a second decorative surface that is spaced apart, opposed and different from the first decorative surface. A first opening is formed in the first decorative surface and sized to receive a planar display pane. A second opening is formed in the second decorative surface and sized to receive the planar display pane.

According to at least another embodiment, a method for assembling a planar display assembly, provides a frame with first and second spaced apart and opposed decorative surfaces. A first opening is formed in the first decorative surface and a second opening is formed in the second decorative surface. A planar display pane is inserted into one of the first opening to provide a first decorative planar display assembly or the second opening to provide a second decorative planar display assembly.

According to a further embodiment, retainers are attached to the frame to retain the planar display pane to the frame.

According to another further embodiment, the planar display pane is removed from the first opening. The planar display pane is inserted into the second opening to provide the second decorative planar display assembly.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Conventional planar display assemblies, such as mirror assemblies, offer preassembled mirror assemblies with or without a frame. Separate frames and mirror panes are also offered, which require a user to assemble the mirror to the frame. U.S. Pat. No. 9,833,086 B2 discloses customizable mirror assemblies and hardware for interchanging mirror panes with various frames.

Figure 1:
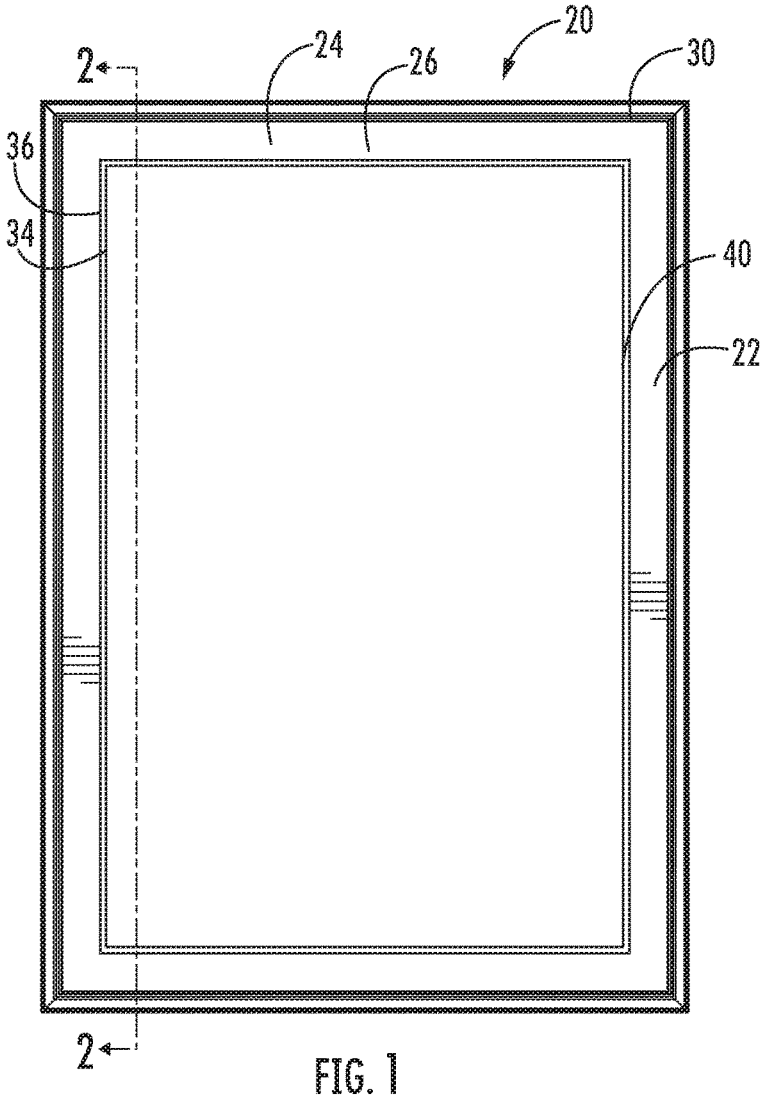
FIG. 1 is a front elevation view of a frame according to an embodiment.
Figure 2:
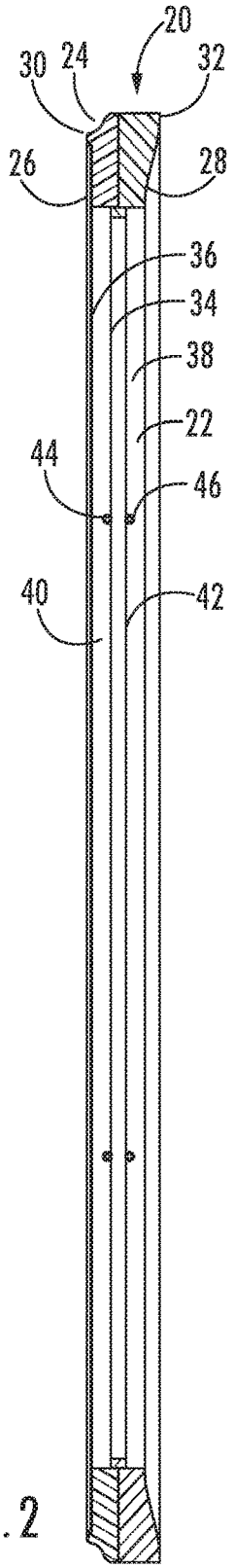
FIG. 2 is a side section view of the frame taken along line 2-2 in FIG. 1.
Figure 3:
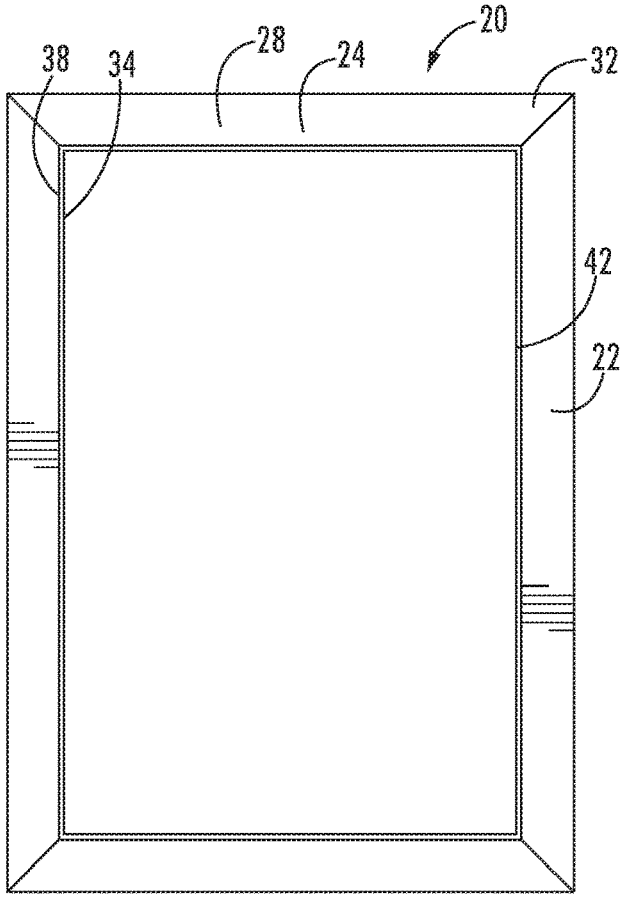
FIG. 3 is a rear elevation view of the frame of FIG. 1.

Referring now to FIGS. 1-3, a dual-sided frame 20 is illustrated according to an embodiment. The frame 20 is illustrated as generally rectangular with a pair of side members 22 and a pair of cross members 24. Although the frame 20 is illustrated as a rectangle, any suitable shape is contemplated, such as oval or the like. The side members 22 and the cross members 24 may be formed integrally or may be formed separately.

The frame 20 provides a pair of distinct decorative surfaces 26, 28 on spaced apart, opposed sides of the frame 20. The distinct decorative surfaces 26, 28 permit the end user to display the frame 20 with either side facing outward for two different frame styles or designs. This interchangeability permits customization of a planar display pane assembly, such as a mirror assembly or picture frame. In the depicted embodiment, the decorative surfaces 26, 28 differ in shape and style. For example, the first decorative surface 26 includes a riser 30 that is offset from an outside perimeter. In contrast, the second decorative surface 28 includes a riser 32 at the outer perimeter.

The first decorative surface 26 and the second decorative surface 28 may also have differing surface finishes, including texture, color, paint, stain and the like. The frame 20 includes a through opening 34 for viewing the planar display pane in either direction.

A pair of openings 36, 38 are each formed into one of the decorative surfaces 26, 28. The first opening 36 is formed into the first decorative surface 26, and the second opening 38 is formed into the second decorative surface 28. The first opening 36 and the second opening 38 each have a common perimeter that is greater than the through opening 34 and sized to receive the planar display pane. The first and second openings 36, 38 are each formed to a blind depth to provide an abutment surface 40, 42 within each opening 36, 38. Each opening 36, 38 in combination with the corresponding abutment surface 40, 42 formed into the frame provide a rabbet for receiving the planar display pane. However, unlike prior art frames, the frame 20 includes a pair of rabbets 36, 40 and 38, 42 for receiving the planar display pane.

Referring now to FIG. 2, the frame 20 also includes a plurality of fasteners in each opening 36, 38 for retaining the planar display pane. According to one embodiment, a plurality of apertures 44, 46 are formed into the frame 20. Each plurality of apertures 44, 46 is formed generally perpendicular to a sidewall formed by the corresponding opening 36, 38 and intersects the opening 36, 38.

Figure 4:
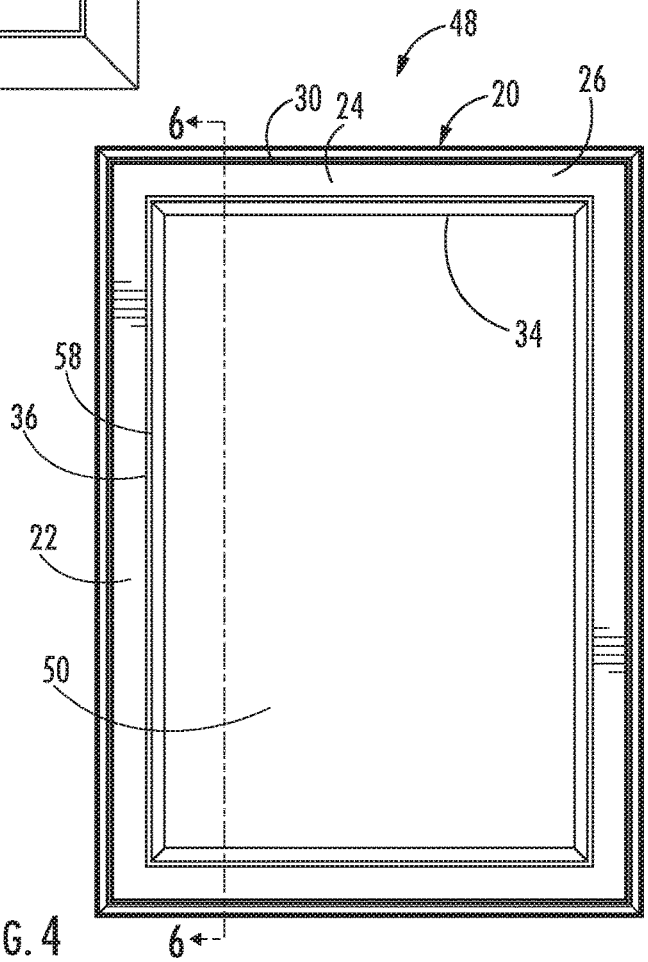
FIG. 4 is a front elevation view of a planar display pane assembly according to an embodiment.
Figure 5:
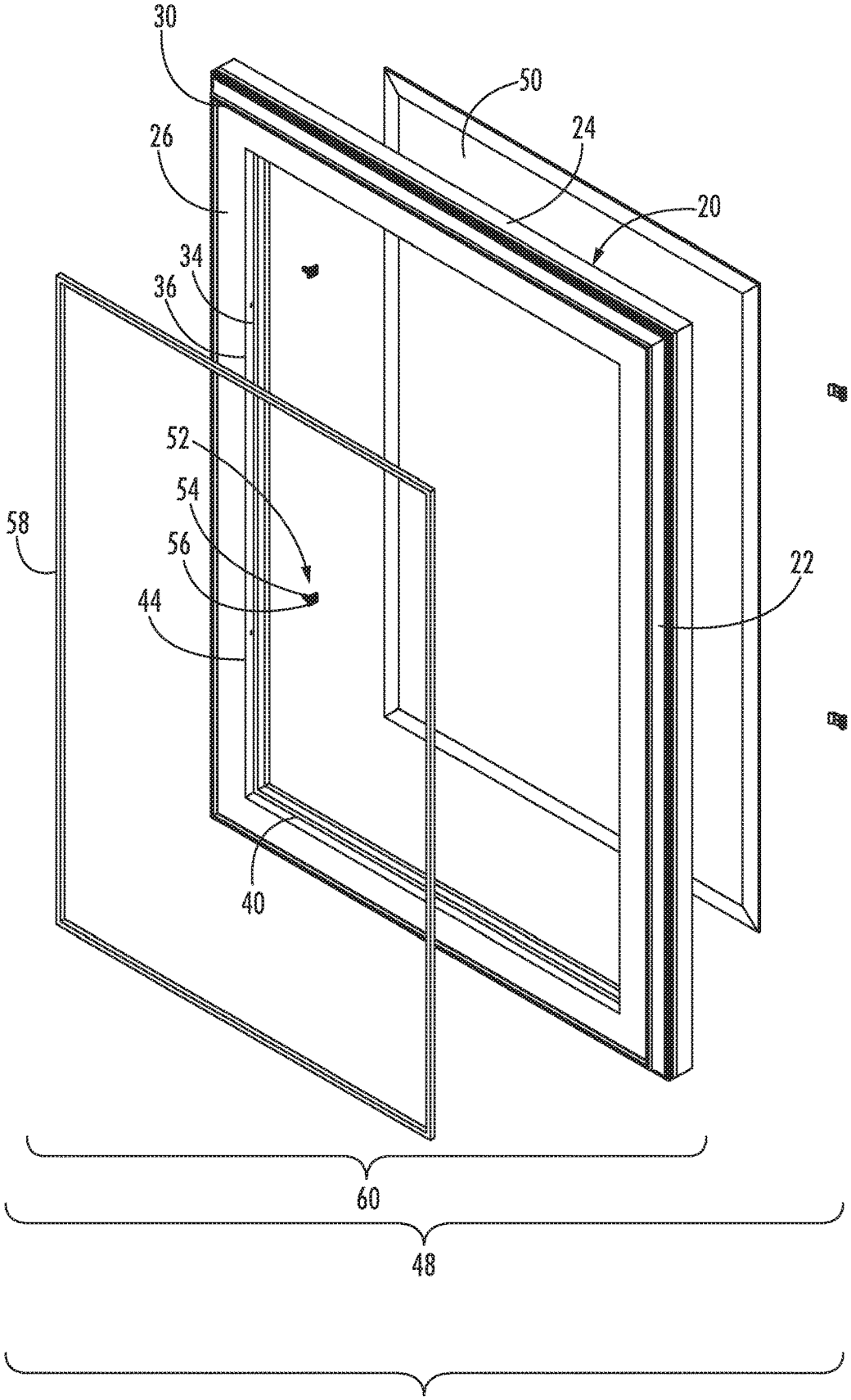
FIG. 5 is an exploded front perspective view of the planar display pane assembly of FIG. 4.
Figure 6:
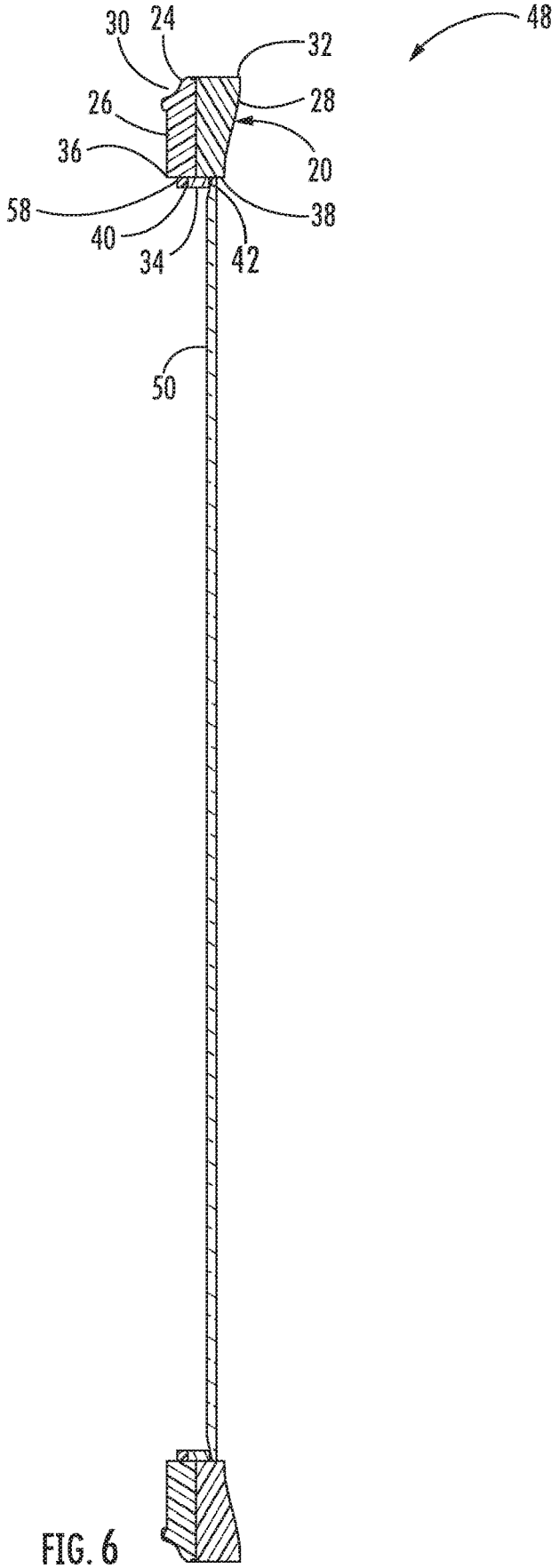
FIG. 6 is a side section view of the planar display pane assembly taken along line 6-6 in FIG. 4.

FIGS. 4-6 illustrate a planar display pane assembly 48 according to another embodiment. The planar display pane assembly 48 includes the frame 20 of FIGS. 1-3. A planar display pane 50 is assembled to the frame 20. The planar display pane 50 is depicted as a mirror pane 50. The mirror pane 50 is received within the second opening 38 and engages the second abutment surface 42. The mirror pane 50 has a standardized size to be interchangeable within the first opening 36 or the second opening 38. The mirror pane 50 and the first decorative surface 26 collectively provide the first decorative planar display assembly 48.

Referring now to FIG. 5, the planar display pane assembly 48 includes a plurality of retainers 52 to attach to the frame 20 at the second plurality of apertures 46 and to secure and retain the mirror pane 50 within the second opening 38. Each of the retainers 52 includes a pin 54 that is sized to be received within one of the second plurality of apertures 46. Each of the retainers 52 also includes a retainer body 56 to engage a rear surface of the mirror pane 50. Various retainer styles and features are contemplated. Forrest et al. U.S. Pat. No. 9,833,086 B2, which issued on Dec. 5, 2017 discloses various suitable retainers and is incorporated in its entirety by reference herein. Forrest et al. U.S. Patent Application Publication No. US 2018/0125268 A1, which published on May 10, 2018 also discloses another suitable retainer and is incorporated in its entirety by reference herein.

The planar display pane assembly 48 also includes a trim insert 58 that is sized to be received in the first opening 36 and the second opening 38. In the depicted embodiment, the trim insert 58 is installed into the first opening 36. The trim insert 58 conceals the first plurality of apertures 44 and the first abutment surface 40 to provide an ornamental transition from the first decorative surface 26 to the mirror pane 50. The trim insert 58 may include projections (not shown) to engage the first plurality of apertures 44 and retain the trim insert 58 in the first opening 36.

Although the mirror pane 50 is illustrated installed into the second opening 38 of the frame 20, the frame 20 permits a second decorative planar display pane assembly 48. For example, the mirror pane 50 can be installed into the first opening 36 in engagement with the first abutment surface 40. The retainers 52 are then installed into the first plurality of apertures 44 to retain the mirror pane 50 in the first opening 36. The trim insert 58 is installed into the second opening 38 in engagement with the second abutment surface 42 to conceal the second abutment surface 42 and the second plurality of apertures 46. The second decorative surface 28 of the frame 20, the mirror pane 50, and the trim insert 58 collectively provide the second decorative planar display pane assembly 48. Alternatively, a second trim insert 58 may be provided with a different shape or style to match the second decorative surface 28 of the frame 20.

The interchangeability of the frame 20 permits an end user to revise or update the planar display assembly 48 without purchasing additional components. The end user may remove the mirror pane 50 from the frame 20 and reinstall the mirror pane 50 into the other side of the frame 20 in order to change the ornamental decorative appearance of the planar display assembly 48.

The mirror assembly 48 provides standardized or common mounting and assembly hardware to offer ease in customer selection, customization, assembly, installations, modifications, replacements, and the like. The mirror pane 50 is interchangeable with other mirror panes that have a common shape and size, but offer variations in style, such as deluxe glass, which may be clearer, have anti-fog treatment, a beveled perimeter edge, etching, and the like. Likewise, the frame 20 may be formed from various materials, such as wood, extruded metals or plastics, injection molded frames, expanded foam, or the like.

A frame assembly 60 may be retailed separately than the mirror pane 50 to assist in user customization and selection of the mirror frame 20 and the mirror pane 50. The frame assembly 60 may be packaged to include the frame 20, retainers 52, and trim insert(s) 58.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A frame assembly comprising:

a frame sized to receive a planar display pane in one of a first opening and a second opening that is spaced apart and opposed to the first opening, with a first decorative surface oriented about the first opening, and a second decorative surface that is different from the first decorative surface, oriented about the second opening, wherein the first decorative surface has a different style than the second decorative surface;

wherein a through opening is formed through the frame to view the planar display pane in either direction of the frame;

wherein the first opening is formed around the through opening;

wherein the second opening is formed around the through opening and facing away from the first opening;

wherein a first plurality of fasteners is formed about the first opening;

wherein a second plurality of fasteners is formed about the second opening; and a plurality of retainers sized to engage the first plurality of fasteners or the second plurality of fasteners to retain the planar display pane to the frame.

2. The frame assembly of claim 1 wherein the first decorative surface has a different surface finish than the second decorative surface.

3. The frame assembly of claim 1 wherein the first decorative surface has a different shape than the second decorative surface.

4. A planar display pane assembly comprising:

the frame assembly of claim 1; and the planar display pane received within the first opening or the second opening.

5. The planar display pane assembly of claim 4 wherein the planar display pane comprises a mirror.

6. The frame assembly of claim 1 further comprising a trim member sized to be received in the first opening to cover the first plurality of fasteners when the planar display pane is received in the second opening.

7. The frame assembly of claim 6 wherein the trim member is sized to be received in the second opening to cover the second plurality of fasteners when the planar display pane is received in the first opening.

8. The frame assembly of claim 1 wherein the first plurality of fasteners includes a first plurality of apertures formed into the frame; and wherein the second plurality of fasteners includes a second plurality of apertures formed into the frame.

9. The frame assembly of claim 8 wherein the plurality of retainers each comprise:

a pin sized to be received in one of the first plurality of apertures or one of the second plurality of apertures; and a retainer body extending from the pin to engage the planar display pane.

10. The frame assembly of claim 8 wherein the first opening is formed to a first blind depth in the frame to provide a first abutment surface to receive and engage the planar display pane; and wherein the first plurality of apertures is formed into the frame intersecting the first opening.

11. The frame assembly of claim 10 wherein each of the first plurality of apertures is formed generally perpendicular to a first inner sidewall formed in the frame by the first opening.

12. The frame assembly of claim 10 wherein the second opening is formed to a second blind depth in the frame to provide a second abutment surface to receive and engage the planar display pane; and wherein the second plurality of apertures is formed into the frame intersecting the second opening.

13. The frame assembly of claim 12 wherein each of the second plurality of apertures is formed generally perpendicular to a second inner sidewall formed in the frame by the second opening.

14. A frame assembly comprising:

a frame with a first decorative surface and a second decorative surface that is spaced apart, opposed and has a different finish from the first decorative surface, with a first opening formed in the first decorative surface and sized to receive a planar display pane, and a second opening formed in the second decorative surface and sized to receive the planar display pane;

wherein a through opening is formed through the frame to view the planar display pane in either direction of the frame;

wherein the first opening is formed around the through opening;

wherein the second opening is formed around the through opening and facing away from the first opening;

wherein a first plurality of fasteners is formed about the first opening;

wherein a second plurality of fasteners is formed about the second opening; and a plurality of retainers sized to engage the first plurality of fasteners or the second plurality of fasteners to retain the planar display pane to the frame.

15. A planar display pane assembly comprising:

the frame assembly of claim 14; and the planar display pane received within the first opening or the second opening; and wherein the planar display pane comprises a mirror.

16. The frame assembly of claim 14 further comprising a trim member sized to be received in the first opening to cover the first plurality of fasteners when the planar display pane is received in the second opening; and wherein the trim member is sized to be received in the second opening to cover the second plurality of fasteners when the planar display pane is received in the first opening.

17. The frame assembly of claim 14 wherein the first plurality of fasteners includes a first plurality of apertures formed into the frame; and wherein the second plurality of fasteners includes a second plurality of apertures formed into the frame.

18. The frame assembly of claim 17 wherein the plurality of retainers each comprise:

a pin sized to be received in one of the first plurality of apertures or one of the second plurality of apertures; and a retainer body extending from the pin to engage the planar display pane.

19. The frame assembly of claim 17 wherein the first opening is formed to a first blind depth in the frame to provide a first abutment surface to receive and engage the planar display pane; and wherein the first plurality of apertures is formed into the frame intersecting the first opening.

20. The frame assembly of claim 17 wherein the second opening is formed to a second blind depth in the frame to provide a second abutment surface to receive and engage the planar display pane;

wherein the second plurality of apertures is formed into the frame intersecting the second opening; and wherein each of the second plurality of apertures is formed generally perpendicular to a second inner sidewall formed in the frame by the second opening.

* * * * *